United States Patent [19]

Klinder

[11] 4,066,306

[45] Jan. 3, 1978

[54] UTILITY CABINET WITH TILTING MIRRORED DOOR

[76] Inventor: Edward F. Klinder, 3621 S. Scoville Ave., Berwyn, Ill. 60402

[21] Appl. No.: 727,247

[22] Filed: Sept. 27, 1976

[51] Int. Cl.[2] ..... A47B 67/00; A47G 1/00; G02B 5/08; A47B 49/00

[52] U.S. Cl. ..... 312/224; 312/245; 312/326

[58] Field of Search ..... 312/224, 225, 226, 227, 312/242, 248, 251, 112, 114, 326–329

[56] References Cited

U.S. PATENT DOCUMENTS

| | | | |
|---|---|---|---|
| 1,263,384 | 4/1918 | De Labaume | 312/227 |
| 1,700,121 | 1/1929 | De Boer | 312/242 |
| 2,036,794 | 4/1936 | Derman | 312/248 |
| 3,869,183 | 3/1975 | Frank | 312/226 |
| 3,885,844 | 5/1975 | Schneider | 312/227 |

FOREIGN PATENT DOCUMENTS

| | | | |
|---|---|---|---|
| 38,633 | 6/1912 | Sweden | 312/226 |

*Primary Examiner*—Paul R. Gilliam
*Assistant Examiner*—Victor N. Sakran

[57] ABSTRACT

A utility cabinet is disclosed comprising a housing having an opening therein and a frame positioned in front of the opening to pivot towards and away from the opening. A mirrored door is mounted in the frame and a retractable joint extends from the frame into the housing through the opening so that when the frame is pivoted away from the housing the separation between the frame and the periphery of the opening will be closed off.

5 Claims, 2 Drawing Figures

UTILITY CABINET WITH TILTING MIRRORED DOOR

SUMMARY OF THE INVENTION

The present invention relates to a utility cabinet apparatus comprising a cabinet housing having an opening therein. A door frame extends around the opening and is pivotally connected to the housing for pivotally swinging a section of the edge of the frame towards and away from the opening. A door is openably and closeably mounted in the frame for providing access to the inside of the housing through the opening. A reflecting mirrored surface is provided on the surface of the door, the reflecting mirrored surface facing away from the interior of the housing. A retractable joint extends from the periphery of the frame to the periphery of the opening so that when the frame is pivoted away from the opening, the separation of the periphery of the frame and the periphery of the opening is closed off. An adjusting member is provided for positioning the frame pivotally with respect to the opening.

The retractable joint may comprise a wall secured to the periphery of the frame and adapted to slidingly engage the periphery of the opening and to pivotally move into and away from the housing with the frame.

The adjusting member may comprise a clamp for clampingly engaging the wall extending from the periphery of the frame.

The clamp may comprise a slot in the wall member extending away from the periphery of the frame and a shaft extending from the outer wall of the housing through the slot. A friction member extends from the shaft for frictionally engaging the wall extending from the periphery of the frame in the area of the wall next adjacent the slot.

The housing, the opening and the frame may be rectangular, the frame being pivotally attached to the bottom of the opening by a hinge.

The door may comprise a pair of overlapping sliding doors mounted in first and second channels running respectively along the top and bottom lateral edges of the frame.

The sliding doors may further comprise glass doors having a reflecting mirrored surface on one plane thereof.

DETAILED DESCRIPTION

Figure 1:
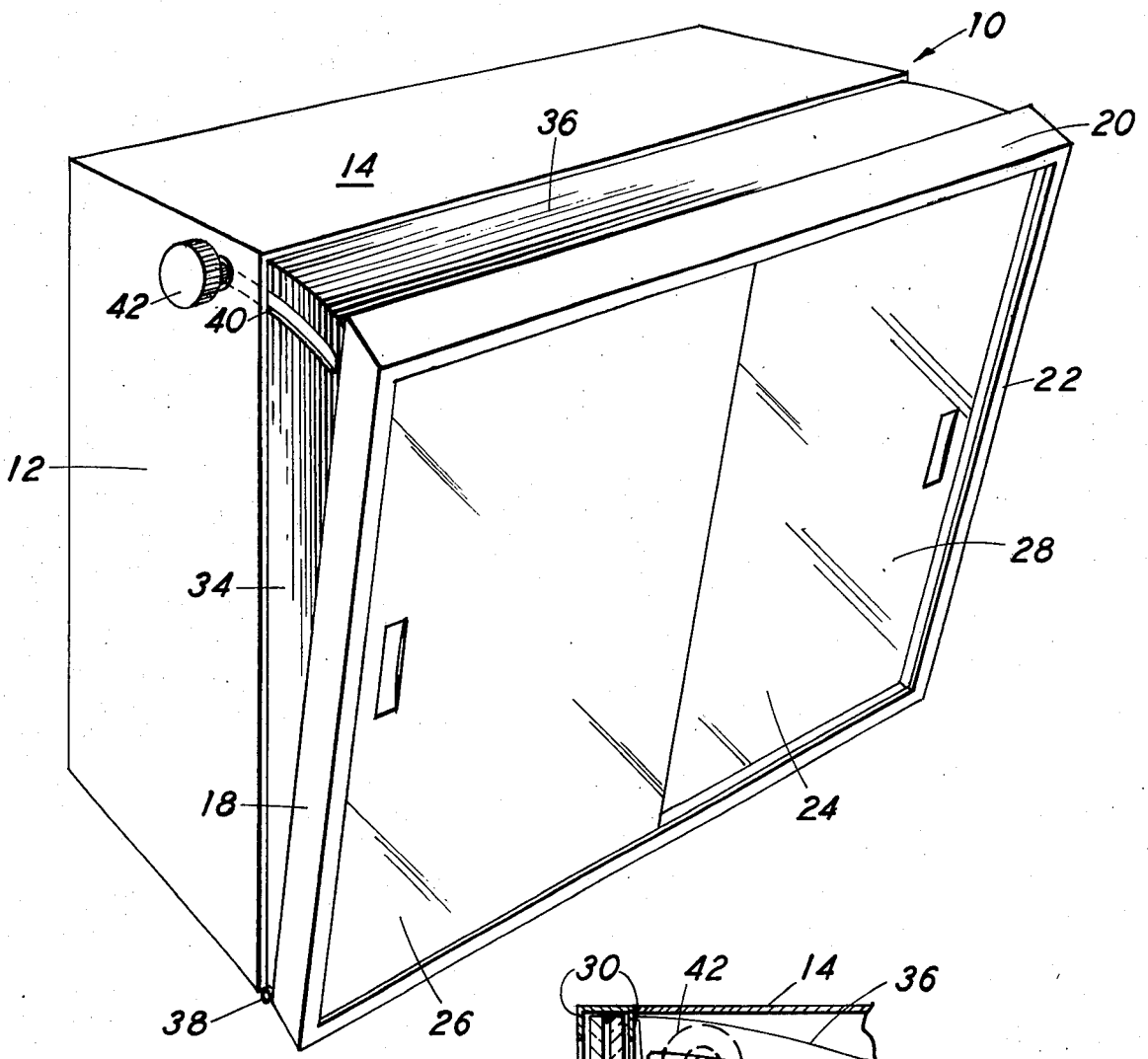
FIG. 1 comprises a perspective view of a utility cabinet comprising a housing and a frame pivotally secured to the housing, a retractable joint extending from the periphery of the frame into an opening of the housing, a door having a reflecting mirror surface thereon being openably and closably mounted in the frame according to one embodiment of the present invention.
Figure 2:
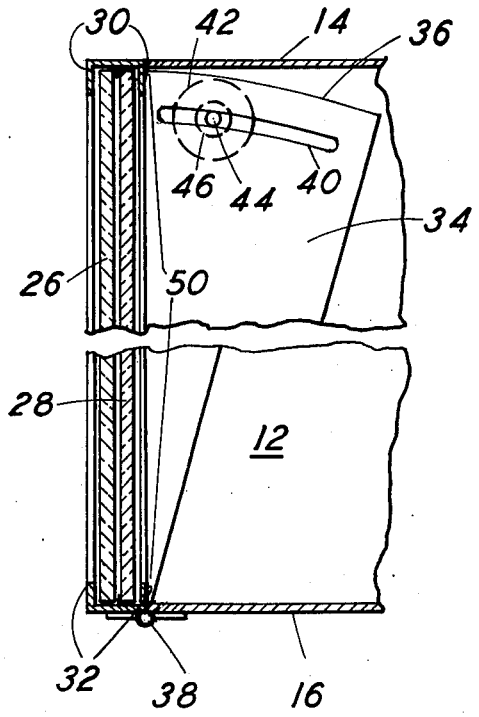
FIG. 2 comprises a partial side elevation in section illustrating in further detail the retractable joint of the apparatus of FIG. 1 in combination with an adjusting member for positioning the frame pivotally with respect to the opening in the housing according to another embodiment of the present invention.

Utility cabinets, vanities and toilet kits having adjustable mirrors are disclosed in the prior art United States patents Schneider U.S. Pat. No. 3,885,884; Mitchel, et al. U.S. Pat. No. 3,176,942; LaBarre U.S. Pat. No. 2,773,728; Viney U.S. Pat. No. 2,592,086; Brennan U.S. Pat. No. 1,730,555; Carlson U.S. Pat. No. 1,588,093; Martens U.S. Pat. No. 1,661,899 and Patten U.S. Pat. No. 577,204.

It is an object of the present invention to provide a novel utility cabinet having an adjustable mirror therein.

It is a further object of the present invention to provide a utility cabinet having an adjustable mirror therein which tilts outwardly from the bottom edge of the utility cabinet on a frame so that the angle reflection of the mirror may be changed and adjusted to suit the height of a person using the mirror.

It is a further object of the present invention to provide a utility cabinet having an adjustable mirror therein mounted on a frame which tilts at the base of the cabinet outwardly and away from the cabinet and which has a retractable joint therein for closing off the separation between the frame and the cabinet to thereby prevent dirt and moisture such as water vapor or steam from collecting on the contents of the cabinet when the mirror is being used in one of several adjustable positions.

These and other objects have been achieved according to the present invention and will become apparent by reference to the disclosure and claims that follow as well as the appended drawing. Referring to the drawing, a utility cabinet 10 is illustrated comprising a rectangular housing having a side wall 12 a top wall 14 and a bottom wall 16, an opposed side wall relative to side wall 12 also being provided however not being illustrated. Optionally, a back wall may be provided (not illustrated) on the housing. A rectangular frame is pivotally secured to the bottom lateral edge of the housing by means of a piano hinge 38, the frame comprising a side member 18, a top member 20, a side member 22 and a bottom member 24, members 20 and 24 also comprising the lateral members of the frame and having channels 30 and 32 therein respectively for slidably receiving glass doors 26 and 28, one plane of glass doors 26 and 28 having a reflecting mirror surface thereon. A retractable joint is provided comprising a wall member extending around the periphery of the frame including a wall member 34 and a wall member 36. A wall member opposite that of wall member 34 is also provided however is not illustrated.

An adjusting member for positioning the frame pivotally with respect to a front opening in the housing is provided and comprises a handle such as a knob 42 having a shaft 44 thereon which extends through a slot 40 in the side wall 34 of the retractable joint. A friction washer 46 is provided on the terminal end of shaft 44 for frictionally engaging the wall area of wall 34 next adjacent the slot 40 so that when the frame is pivoted away from the opening 50 of the housing in any one of a number of settings, the frame will be fixed and held in position by the frictional engagement of washer 46 with respect to the wall area next adjacent slot 40.

In use, access to the housing may be had by the opening 50 by slidably positioning either of doors 26 or 28 in the frame by moving doors 26 and 28 laterally in the channels 30 and 32. When the mirrored surface on doors 26 and 28 is to be angled towards the hinge 38, the frame may be pivoted about hinge 38 and will be held in place by the frictional engagement of washer 46 on the terminal end of shaft 44, washer 46 frictionally engaging the wall area next adjacent the slot 40. The retractable joint (comprising the wall member 34 and 36 and an opposed wall member relative to wall member 34, but not illustrated), extends out of the opening 50 in the housing and closes any of the separation between the periphery of the frame and the periphery of the opening 50 so that when the utility cabinet is employed as a bathroom cabinet, moisture from water vapor or steam generated from the use of hot water in the bathroom will be substantially kept out of the interior of the housing and further, any dirt and the like will also be prevented from entering the interior of the housing while the mirror is pivotally moved away from the housing as is illustrated in FIG. 1.

Although the invention has been described by reference to some embodiments, it is not intended that the novel utility cabinet apparatus be limited thereby, but that modifications thereof are intended to be included as falling within the broad spirit and scope of the foregoing disclosure, the following claims and the appended drawing.

What is claimed is:

1. Utility cabinet apparatus comprising a cabinet housing means having opening means therein, door frame means extending around said opening means and pivotally connected to said housing means for pivotally swinging a section of the edge of said frame means towards and away from said opening means, door means openably and closably mounted in said frame means for providing access to the inside of said housing means through said opening means, reflecting mirror surface means on said surface of said door means facing away from the interior of said housing means, retractable joint means extending from the periphery of said frame means to the periphery of said opening means so that when said frame means is pivoted away from said opening means the separation of the periphery of said frame means and the periphery of said opening means is closed off, said retractable joint means comprising wall means secured to the periphery of said frame means and is adapted to slidingly engage the periphery of said opening means and to pivotally move into and away from said housing means with said frame means, clamp means clampingly engaging said wall means for positioning said frame means pivotally with respect to said opening means.

2. The apparatus of claim 1 where said clamp means comprises slot means in said wall means, shaft means extending from the outer wall of said housing means through said slot means, friction means extending from said shaft means for frictionally engaging said wall means in the area of said slot means.

3. The apparatus of claim 1 where said housing means, said opening means and said frame means are rectangular, said frame means being pivotally attached to the bottom of said opening by a hinge.

4. The apparatus of claim 3 where said door means comprises a pair of overlapping sliding doors mounted in first and second channels running respectively along the top and bottom lateral edges of said frame means.

5. The apparatus of claim 4 where said sliding doors comprise glass doors having a reflecting mirror surface on one plane thereof.

* * * * *